United States Patent [19]

Brannan

[11] 4,100,049

[45] Jul. 11, 1978

[54] COATED CATHODE FOR ELECTROLYSIS CELLS

[75] Inventor: James R. Brannan, Painesville, Ohio

[73] Assignee: Diamond Shamrock Corporation, Cleveland, Ohio

[21] Appl. No.: 814,703

[22] Filed: Jul. 11, 1977

[51] Int. Cl.[2] ..... C25B 9/00; C25B 11/04

[52] U.S. Cl. ..... 204/242; 204/290 R

[58] Field of Search ..... 204/290 R, 242, 290 F

[56] References Cited

U.S. PATENT DOCUMENTS

| | | | |
|---|---|---|---|
| 3,684,543 | 8/1972 | Denora et al. | 204/290 F X |
| 3,810,770 | 5/1974 | Bianchi et al. | 204/290 F X |
| 4,005,004 | 1/1977 | Seko et al. | 204/290 R X |
| 4,012,296 | 3/1977 | Stephens et al. | 204/290 R X |

*Primary Examiner*—John H. Mack
*Assistant Examiner*—D. R. Valentine
*Attorney, Agent, or Firm*—Stephen A. Littlefield

[57] ABSTRACT

An active coating comprised of a mixture of palladium oxide and zirconium dioxide deposited on a metal substrate selected from a group consisting of iron, nickel, cobalt and alloys thereof, results in a lower hydrogen overpotential at the cathode in the electrolysis of aqueous alkali metal halide solutions. Salts of the component metals of the coating are deposited on the cathode surface preferably by painting. The coating metals are then converted to the corresponding metal oxides through the heating of the coating and substrate to 300° to 600° C in an oxidizing atmosphere such as air or oxygen. The coating results in a lowering of the hydrogen discharge overpotential at the cathode surface of about 50 to 100 millivolts as compared with the hydrogen discharge overpotential for the mild steel substrate commonly used as a cathode in electrolysis cells.

6 Claims, No Drawings

COATED CATHODE FOR ELECTROLYSIS CELLS

COATED CATHODE FOR ELECTROLYSIS CELLS

This invention relates to electrolysis cells for the electrolytic production of halogens and alkali metal hydroxide and more specifically to a coating for lowering the hydrogen discharge overpotential of the electrolysis reaction at the cathode surface.

BACKGROUND OF THE INVENTION

In the electrolysis of aqueous alkali metal halide solutions in electrolytic cells having a diaphragm or membrane separator, the applied voltage required is the total of the decomposition voltage of the compounds being electrolyzed, the voltage required to overcome the resistance of both the electrolyte and the electrical connectors of the cell, and the overpotential required to overcome the passage of current at the surface of the cathode and the anode. The overpotential is related to such factors as the nature of the ions being charged or discharged, the current density at the electrode surface, the base material from which the electrode is constructed, the surface formation of the electrode, i.e., whether the electrode is smooth or rough, the temperature of the electrolyte, and the presence of impurities in the electrolyte and the electrodes. At the present time, knowledge of the phenomenon of overpotential is not fully understood. It has been observed that there is a characteristic overpotential for each particular combination of discharging ion, electrode, electrolyte, current density, etc.

Because of the large quantities of chlorine and caustic (sodium hydroxide) required by a modern society, millions of tons of these materials are produced, principally by electrolysis of aqueous solutions of sodium chloride, each year. A reduction of as little as 0.05 volts (50 millivolts) in the working voltage of a cell translates into a meaningful economic savings, especially in the light of today's increasing power costs and energy conservation measures. As a result, the electrochemical industry is constantly in search of means which will reduce the voltage requirements for such electrolytic processes.

The development of the dimensionally stable anode and coatings therefor have resulted in a reduction in the anode and cathode spacing within electrolysis cells, this advance resulting in a large reduction in the voltage since electrolyte resistance is reduced within the narrow space between the electodes.

Cathodes for electrolysis cells are generally made of a mild steel generally in the form of expanded mesh, screen, or perforated plate because of the low cost of this material and its resistance to the caustic environment of the catholyte.

Various coatings have been proposed for reducing the hydrogen discharge overpotential at the electrode surface of electrolysis cells.

U.S. Pat. No. 3,632,498, Beer, describes a coating comprising a solid solution of precious metal oxides and film-forming metal oxides on a film-forming metal substrate to be used as an anode in electrolytic processes. Similarly, U.S. Pat. No. 3,711,385, Beer, describes a mixed crystal anode coating on a film-forming metal base comprising oxides of platinum metals group with oxides of film-forming metals.

Bennett, et al, U.S. Pat. No. 3,677,975, also describes a coating comprising a solid solution of a valve metal dioxide and a precious metal dioxide applied to a valve metal substrate. A coated electrode in accordance with this invention may be used as an anode in electrolytic processes.

Moss, U.S. Pat. No. 3,869,312, describes a coating for an anode comprising a film-forming metal substrate, a first layer comprising a mixture of a platinum group metal and a film-forming metal oxide and a second layer of coating consisting of a film-forming metal oxide.

In all of the above-mentioned patents, the preferred mixed oxide coating is applied only to a film-forming metal substrate and is generally used only as an anode coating for electrolytic processes since hydrogen embrittlement of valve metal substrates occurs when such coated electrodes are used as cathodes. Further, the coating mixtures are applied as a solution utilizing an organic solvent such as alcohols, e.g. isopropanol or n-pentanol. The utilization of such organic solvents not only increases the cost of the coatings but also presents a health and fire hazard.

As used in this specification, film-forming metals will be understood to include metals which form a protective film on their surfaces such as aluminum and the valve metals titanium, tantalum, zirconium, niobium and vanadium. Precious metals include principally gold, silver and the platinum group metals platinum, palladium, rhenium, ruthenium, osmium and iridium.

U.S. Pat. No. 3,654,188, Kolb, describes a process for preparing solid solutions of valve metal dioxides and precious metal dioxides independent of a valve metal substrate. The patent states that prior to its disclosure, it was necessary that such solid solutions be formed on a valve metal substrate and that attempts to form such a solid solution on other substrates resulted in only loosely adherent physical mixtures of the oxides in seperate crystaline phases.

It has been found that the hydrogen discharge overpotential at the cathode surface is lowered by a coating comprising a mixture of precious metal oxides and valve metal oxides, however, the coating has formerly not found commercial acceptance because of the aforementioned hydrogen embrittlement of the valve metal substrates upon which these coatings were necessarily formed.

SUMMARY OF THE INVENTION

In accordance with the present invention, an adherent coating comprising a precious metal oxide particularly palladium oxide and a valve metal oxide, particularly zirconium dioxide, is formed on the surface of a cathode substrate for use in electrolytic processes such as the production of chlorine and caustic. The cathode substrate may be selected from a group consisting of iron, nickel, cobalt, and alloys thereof including steel, stainless steel and the like.

Further in accordance with the invention, a mild steel cathode substrate is provided with a mixed oxide coating comprising palladium oxide and zirconium dioxide.

Further, in accordance with the invention, a coating solution having an aqueous base is utilized rather than employing organic solvents commonly used in prior art coating processes.

Still further in accordance with the invention, a cathode coating of a mixture of palladium oxide and zirconium dioxide may additionally include a diluent selected from a group consisting of oxides of nickel, cobalt, and mixtures thereof.

Further in accordance with the invention, a method is disclosed through which a mixed oxide coating of palladium oxide and zirconium dioxide is applied to a mild steel substrate in order to provide an adherent cathode coating which results in the reduction in the hydrogen discharge overpotential for electrolytic reaction occuring at a cathode surface in an electrolytic cell.

It is therefore a principal object of this invention to provide a mixed oxide coating on a mild steel cathode substrate and a method of making same, such coating comprising a mixture of palladium oxide and zirconium dioxide, which coating results in a lowering of the hydrogen discharge overpotential at the cathode in the electrolysis of aqueous solutions.

It is a further object of this invention to provide a cathode having a coating comprising a mixture of palladium oxide and zirconium dioxide which avoids any hydrogen embrittlement of the substrate common with prior electrodes having such a coating thereon since the substrate in accordance with the present invention is mild steel or the like rather than a valve metal.

It is yet another object of this invention to reduce the cost of a cathode coating of the type described by introducing a diluent metal oxide into the coating in place of a portion of the palladium oxide.

It is another object of this invention to utilize a coating mixture having an aqueous base thereby avoiding the costs and hazards associated with the use of prior coating compositions utilizing organic solvents.

DETAILED DESCRIPTION OF THE INVENTION

The invention will now be more fully described and illustrated through a description of a preferred embodiment thereof. Such description is presented for the purposes of illustration and should not be construed as a limitation upon the applicability of such coatings applied to cathodes for use in any analogous electrolytic process other than those specifically mentioned.

For use in membrane cells, a planer cathode is generally provided, while in diaphragm type cells, the cathode is usually formed into a rectangular tube and a hydraulically-permeable diaphragm is applied thereto. For reasons of economy, cathode substrates are generally made of ferrous materials such as mild steel, iron, stainless steel or other ferrous alloys. Optionally, nickel or cobalt may be used as substrate material or a nickel or cobalt surface may be applied as a coating on a ferrous cathode. These materials are resistant to hydrogen embrittlement and therefore have much longer useful lives when compared to cathodes made of titanium or other valve metals.

Cathodes are generally made from a material in the form of an expanded metal mesh, metal wire screening, or perforated plate, the selection of materials being dictated by the design considerations of the electrolytic cell. There is little difference in the use of these forms of cathode material and thus the applicability of the present invention shall be considered to include coatings on any of these or analogous cathode substrate forms.

In accordance with normal preparation procedures for cathode substrates to be used in electrolytic cells, the surface of the substrate is preferably prepared by cleaning and sand blasting and/or acid etching in order that the surface may be more receptive to the cathode coating.

Following the preferred preparation of the cathode substrate, the cathode is coated with an aqueous solution containing a source of palladium metal and a source of zirconium metal and the coating is dried and then heated to 300–600° C in an oxidizing atmosphere such as air or oxygen. This treatment results in the formation of a coating comprising palladium oxide and zirconium dioxide on the surface of the cathode substrate. The physical form of the coating is a physical mixture of the oxides rather than a solid solution such as is found in similar coatings on valve metal substrates of the prior art. The palladium oxide/zirconium dioxide coating results in a reduction of about 50 to 100 millivolts in the hydrogen discharge over-potential for the electrolysis of alkaline solutions.

In preparing the aqueous solution for coating the cathode substrate, a source of zirconium metal in the form an organic or inorganic compound is solubilized or substantially solubilized in water. The preferred sources of zirconium include zirconyl nitrate ($ZrO(NO_3)_2$); zirconium alkoxides, such as butyl zirconate and salts such as zirconium sulfate ($Zr(SO_4)_2$). Small amounts of acid, such as acetic acid, may be added to assist in the solubilization of these zirconium compounds although it is not necessary that the compound be fully solubilized.

To the aqueous, preferably acidified solution of a zirconium compound is added a source of palladium, preferably palladium chloride ($PdCl_2$) preferably having a particle size less than about 45 microns. Palladium chloride is only slightly soluble in water, i.e., less than 2 grams per liter, but it is not necessary that all of the palladium compound by fully solubilized. The aqueous slurry mixture may optionally be ball milled for a period of time so as to further reduce the size of the suspended particles with the result that a better coating is ultimately formed.

The resultant slurry containing a source of palladium and zirconium is then applied to the surface of the cathode substrate such as by painting. The coating is dried and cured in an oxidizing atmosphere at 300 to 600° C whereupon the preferred palladium oxide/zirconium dioxide coating is formed. It may be necessary to apply and cure a plurality of coats in succession in order to build up a sufficient coating thickness to insure durability of a coating under conditions of normal use.

The following example will illustrate the preferred coating of the invention as applied to a screen-form mild steel cathode substrate which has been pretreated by vapor degreasing and sand blasting.

EXAMPLE 1

Two grams of zirconyl nitrate is dissolved in 10 ml of water and 1 ml acetic acid. To this solution is added 1.5 grams palladium chloride particles of a size less than 45 microns. The resultant slurry mixture is ball milled for 2 hours in order to solubilize as much palladium chloride as possible and to reduce the size of the nonsolubilized palladium chloride particles. The resulting slurry is painted onto the mild steel screen and treated at 125° C for three minutes to dry the coating. The coating is then cured at 500° C for seven minutes in air to convert the palladium chloride to palladium oxide and the zirconyl nitrate to zirconium dioxide. This coating and treatment procedure is repeated until 5 coats are applied. The resultant palladium oxide/zirconium dioxide coating has a thickness of approximately 10 microns.

The coated screen is then tested by immersion in a solution of 100 grams per liter sodium hydroxide at 90° C and is electrically connected as a cathode for the electrolysis at 1 ampere per square inch (asi). The resulting hydrogen discharge potential for the cathode was measured at −1.15 volts versus a Saturated Calomel Electrode. (Compare: sand blasted mild steel has a hydrogen discharge potential of −1.21 to −1.24 volts versus the S.C.E.)

EXAMPLE 2

In order to determine the optimum concentration ratio of zirconium to palladium, for 10 ml solutions of zirconyl nitrate each containing 0.42g zirconium and 1 ml acetic acid (balance water) were made and 0.5, 1.0, 1.5 and 2.0g of $PdCl_2$ were added (0.3, 0.6, 0.9 and 1.2g Pd respectively). The resultant slurries following ball milling as in Example 1 were each painted onto mild steel cathodes and heat cured as in Example 1, applying 5 coats.

The cathodes were tested as in Example 1 with the following results:

TABLE 1

| | ½ asi | 1 asi | 2 asi | 3 asi | 4 asi |
|---|---|---|---|---|---|
| mild steel | −1.19 volts | −1.21 volts | 1.25 volts | 1.28 volts | 1.21 volts |
| 0.5g $PdCl_2$ | −1.10 | −1.12 | 1.16 | 1.19 | 1.22 |
| 1.0g | −1.08 | −1.10 | 1.12 | 1.15 | 1.16 |
| 1.5g | −1.07 | −1.09 | 1.11 | 1.13 | 1.15 |
| 2.0g | −1.07 | −1.09 | 1.11 | 1.13 | 1.15 |

From these data, it can be seen that increasing Pd concentration produces lower cathode potentials up to 1.5g $PdCl_2$ (Pd: Zr :: 0.9 : 0.42 or approximately 2:1 by weight) and that greater palladium concentrations produce little or no improvement. Thus, for reasons of economy, a ratio of about 2 to 1, palladium to zirconium by weight, in the coating is considered optimum.

The preferred mixed oxide coating of the invention may include a diluent which will reduce the amount of costly palladium in the coating material. Up to as much as half of the palladium present in the cathode coating may be replaced by cobalt oxide, nickel oxide and/or mixtures thereof without losing the advantage of the reduction in the hydrogen overpotential resulting in the use of palladium without such diluent.

EXAMPLE 3

A solution of zirconyl nitrate is prepared as in Example 1. To 20 ml of this solution, 0.75 grams of palladium chloride and 1.23 grams of cobalt dinitrate hexahydrate is added. The aqueous mixture is ball milled for two hours and painted onto sand-blasted steel mesh. Identical treatment and curing procedures illustrated in Example 1 are followed and 5 coats of this material is applied.

Under the test conditions of Example 1, a cathode having the diluted palladium oxide/cobalt oxide/zirconium dioxide coating thereon has the following hydrogen discharge potential versus the S.C.E.

TABLE 2

| | ½ asi | 1 asi | 2 asi | 3 asi | 4 asi |
|---|---|---|---|---|---|
| PdO, CoO, $ZrO_2$ | −1.10 volts | −1.11 volts | −1.15 volts | −1.17 volts | −1.19 volts |

This coating constitutes a 50% replacement of the palladium metal of Example 1 by cobalt. Similar results are obtained when nickel is used as a diluent.

While the invention has been described in the more limited aspects of a preferred embodiment including specific examples of the invention, other embodiments thereof have been suggested and still others will occur to those skilled in the art upon the reading and understanding of the foregoing specification. It is intended that all such embodiments be included within the scope of the present invention as limited only by the appended claims.

What is claimed is:

1. In an electrolytic cell for the production of halogen and alkali metal hydroxides or alkali metal hypohalides and chlorates from alkali metal halide solutions wherein said cell is equipped with an anode and a cathode, the improvement which comprises a composite cathode comprising a metal substrate having thereon a coating comprising a mixture of palladium oxide and zirconium dioxide, said metal substrate selected from a group consisting of iron, nickel, cobalt and alloys thereof.

2. The electrolytic cell as described in claim 1 in which said coating further includes cobalt oxide.

3. The electrolytic cell as described in claim 1 wherein said coating further includes nickel oxide.

4. The electrolytic cell as described in claim 1 in which said palladium oxide and zirconium dioxide are present in a ratio of about 2 to 1 of zirconium metal to palladium metal.

5. The electrolytic cell as described in claim 1 wherein there are a plurality of said coatings on said substrate.

6. A composite cathode for electrolytic processes comprising a mild steel substrate and a coating thereon comprising a mixture of palladium oxide and zirconium dioxide.

* * * * *